US006389594B1

(12) United States Patent
Yavin

(10) Patent No.: US 6,389,594 B1
(45) Date of Patent: May 21, 2002

(54) ANTI-BALLISTIC CERAMIC ARTICLES

(75) Inventor: Benjamin Yavin, Rishon Le'zion (IL)

(73) Assignee: Israel Military Industries Ltd., Ramat Hasharon (IL)

( * ) Notice: Subject to any disclaimer, the term of this patent is extended or adjusted under 35 U.S.C. 154(b) by 0 days.

(21) Appl. No.: 09/943,249

(22) Filed: Aug. 30, 2001

(51) Int. Cl.[7] ..... F41H 1/02
(52) U.S. Cl. ..... 2/2.5; 428/911
(58) Field of Search ..... 2/2.5; 428/911

(56) References Cited

U.S. PATENT DOCUMENTS 5,804,757 A * 9/1998 Wynne ..... 2/2.5
5,824,940 A * 10/1998 Chediak et al. ..... 2/2.5
5,996,115 A * 12/1999 Mazelsky ..... 2/2.5
6,009,789 A * 1/2000 Lyons ..... 2/2.5
6,035,438 A * 3/2000 Neal et al. ..... 2/2.5
6,131,193 A * 10/2000 Bachner, Jr. ..... 2/2.5
6,135,006 A * 10/2000 Strasser et al. ..... 2/2.5
6,138,275 A * 10/2000 Sacks ..... 2/2.5
6,154,880 A * 12/2000 Bachner, Jr. ..... 2/2.5
6,159,590 A * 12/2000 Kim ..... 2/159
6,185,738 B1 * 2/2001 Sidebottom ..... 2/102
6,314,858 B1 * 11/2001 Strasser et al. ..... 2/2.5

* cited by examiner

*Primary Examiner*—John J. Calvert
*Assistant Examiner*—Robert H. Muromoto, Jr.
(74) *Attorney, Agent, or Firm*—Barry R. Lipsitz

(57) ABSTRACT

An antiballistic article including a monolithic ceramic plate, an antiballistic backing material affixed to the ceramic monolith, and an outer shell, formed of an antiballistic material including a curable resin, enclosing the backing and ceramic monolith, the curable resin being cured after and while the enclosed backing and ceramic monolith are maintained under isostatic pressure of at least about 10 atmospheres, whereby the compression stresses and bonding mechanism serve to "arrest" the part after the external pressure is released, and a method of forming such an article.

20 Claims, 1 Drawing Sheet

ANTI-BALLISTIC CERAMIC ARTICLES

FIELD OF THE INVENTION

The present invention relates to protective materials and more particularly to anti-ballistic ceramic articles and inserts.

BACKGROUND OF THE INVENTION

Personal ballistic body armor, particularly vests, helmets, and other anti-ballistic articles, are formed generally of anti-ballistic materials which serve to prevent penetration of a bullet. These articles and vests are primarily used for the armed forces but have police and civilian applications as well. However, most are unable to protect properly against trauma, and many are unable to protect against armor piercing bullets. In order to increase the protection provided by conventional body armor, anti-ballistic inserts are incorporated into existing personal ballistic vests. These inserts generally include a ceramic plate for insertion into a pocket in the vest.

However, these inserts must protect against bullet threats as exhibited from armed forces weaponry rifles and the bullets used in such rifles, including armor piercing (AP). The higher bullet threats are of the armor piercing variety, which are stopped by ceramic inserts or other ceramic articles.

In order to stop, i.e., prevent penetration of an AP ballistic threat at a reasonable weight, it has been found that a composite ceramic base must be applied in the form of a ceramic insert in the vest. The least expensive and simplest way is to apply a monolithic plate. These plates are tested to one (1) bullet hit in accordance with the National Institute of Justice NIJ standard 0101.03 Level IV, as well as other standards. This NIJ standard requires only one (1) shot per sample. When these plates are shot more than once, the probability of penetration is high. This is due to the fact that, when the insert is monolithic, a single bullet will crack the whole insert allowing for penetration upon the second bullet strike.

Alternative monolithic plates can be formed from fibers coated with an elastomer, such as that shown in U.S. Pat. No. 4,613,535.

If a multi-hit ballistic panel is required, i.e., one which can withstand more than one hit, it cannot be attained using monolithic inserts. For this purpose, the insert is made of separate tiles connected together, as by gluing onto a substrate. A bullet hitting the target will destroy one or more tiles at a time, and the remaining tiles serve to prevent penetration along the remainder of the insert. Such inserts are shown, for example, in Israel Patent 120854, EP 488465, and U.S. Pat. No. 4,868,040. These inserts are generally expensive to manufacture, since each tile must be abraded to the correct size and fit on the insert. In addition, the tile connection lines and junctions are weakened points from a ballistic point of view.

U.S. Pat. No. 4,760,611 discloses a bullet-proof waistcoat consisting of a plurality of square plates linked together by hinged joints. Each plate has a ceramic core enclosed in a resilient metal, i.e., an aluminum alloy.

SUMMARY OF THE INVENTION

According to the present invention, there is provided a method to produce multi-hit articles based on a monolithic ceramic plate, and the articles formed by the method. Multi-hit articles include those capable of withstanding more than two hits at a distance between hits of between 20 and 100 mm. The invention claims that, in order for a monolithic ceramic article to possess multi-hit capabilities, these ceramics must be arrested. As used in this application, the term arrested means that the ceramic is imprisoned inside an envelope formed of composite materials which press against the ceramic uniformly all over its outer surface. In order to produce such an arrested ceramic, a suitable composition of ballistic materials is provided as a backing for the ceramic, an outer cover, including antiballistic fabric and associated resin, is placed around the backed ceramic, and the product is inserted into an autoclave, hydroclave or other isostatic press, or any similar apparatus or shrink material. Under pressure, the resin is cured, whereby the compression stresses and bonding mechanism serve to "arrest" the part after the external pressure is released.

There is thus provided in accordance with the present invention, an antiballistic article including a ceramic monolith, an antiballistic backing material affixed to the ceramic monolith, and an outer shell, formed of an antiballistic material including a curable resin, enclosing the backing and ceramic monolith, the curable resin being cured after and while the enclosed backing and ceramic monolith is maintained under isostatic pressure of at least about 10 atmospheres.

There is also provided in accordance with the present invention a method of forming an antiballistic article including the steps of forming a ceramic monolith, affixing an antiballistic backing material to the ceramic monolith, enclosing the backing and ceramic monolith by an outer shell formed of an antiballistic material including a curable resin, placing the enclosed backing and ceramic monolith under isostatic pressure of at least about 10 atmospheres, and curing the curable resin while the enclosed backing and ceramic monolith is maintained under isostatic pressure of at least about 10 atmospheres.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
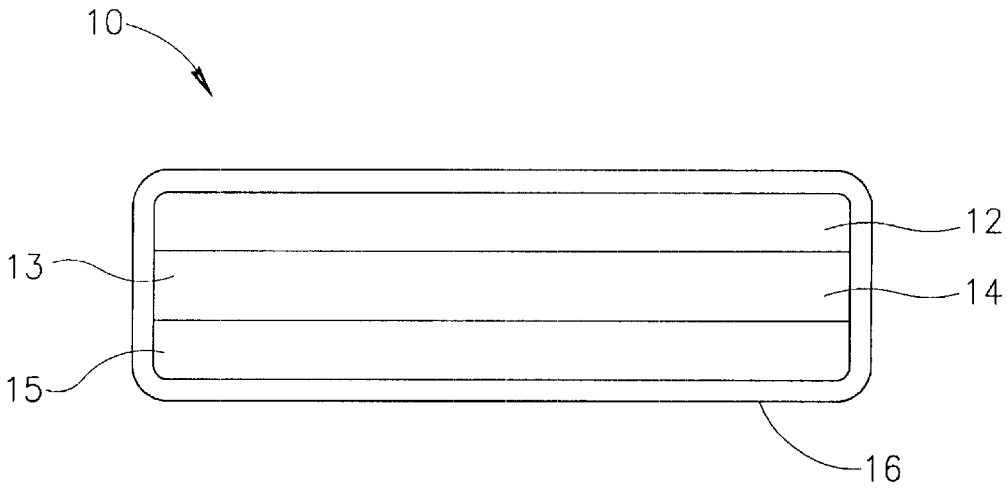
FIG. 1 is a schematic sectional illustration of a ceramic article constructed and operative in accordance with one embodiment of the present invention.

The present invention relates to multi-hit anti-ballistic articles, including personal armor inserts, such as against level III and IV, as detailed in NIJ standard 0101.03, and other similar standards, and other rifle cartridges, such as 7.62 mm (e.g., AK-47 7.62×39, NATO 7.62×51, 30–60, Draganov 7.62×54), 5.56 mm (e.g., M-16, ss-109) 5.45 with AP ammunition and similar, based on a monolithic ceramic plate, and a method of forming such articles. According to the invention, in order for a monolithic ceramic article to possess multi-hit capabilities, these ceramics must be arrested. In order to produce an arrested ceramic, a suitable composition of ballistic materials is provided as a backing for the ceramic, an outer cover, including antiballistic fabric and associated resin, is placed around the backed ceramic, and the product is inserted into an autoclave, hydroclave or isostatic press, or other suitable apparatus or method. Under pressure, the resin is cured, whereby the compression stresses serve to armor the part after the external pressure is released.

The technology is based on the following procedural and material components, as shown in FIG. 1, a schematic illustration of an insert 10 constructed and operative in accordance with one embodiment of the present invention. Insert 10 includes a ceramic monolith 12, backing material 14 for the ceramic, and an outer shell 16, which undergoes a curing process to create an arresting condition in the ceramic monolith.

The ceramic monolith 12 is a plate made of an antiballistic ceramics material, such as alumina, silicon carbide, silicone nitride, boron carbide, tungsten carbide, titanium diborate, or other suitable antiballistic ceramics materials and hybrids. The thickness of this plate is dependent on the relevant threat, and is typically 3–12 mm, for handguns up to armor piercing bullets, and from 6–20 mm for heavier threats, like 0.5 caliber. The dimensions of this plate usually range from 20×20 cm to several meters. The common dimension for personal protection is approximately 25×30 cm, but smaller or larger dimensions are also used. The plate can be flat, curved or double curved, or any other selected shape or geometry applicable for body armor or protection of other materiel. The ceramic plate is usually made of ballistic quality ceramics material, i.e. material adapted to resist an impact of a projectile and possibly even to shatter the projectile, which enhances the ballistic material quality of the entire insert.

The backing material 14, on which the ceramic monolith is glued, or affixed in any other fashion, is designed to absorb the fragments of ceramic and projectile. It is preferably made of a combination of an aramid, HMWPE (high molecular weight polyethylene), Zylon®, carbon, nylon, E glass, S glass, boron, or other material set forth in U.S. Pat. No. 5,677,029 to Allied Signal, or combination hybrids, with the appropriate resins for the selected antiballistic materials. It will be appreciated by those skilled in the art that each antiballistic material has its own, associated resin, in which it is cured in order to improve its antiballistic properties. The ballistic layers can be of any commercial variety, and can be plain weave or unidirectional tape. A combination of aramid with carbon, fiberglass, or any of these materials by themselves, can alternatively be utilized. The combining resin is preferably thermoplastic, but thermosetting can also be utilized. The number of ballistic layers in the backing material is dependent on the thickness of the ceramic monolith, and the relevant threat. Preferably, the thickness of the backing material layer is in the range of about 1 mm to 10 mm.

According to the preferred embodiment of the invention illustrated in FIG. 1, the composite backing 14 includes HMWPE, or an aramid or both, thereby imparting high energy absorption to the finished article. Thus, in this example, the ceramic plate 12 is backed by aramid 13 with an appropriate thermoplastic resin. Behind the aramid 13 are additional layers of HMWPE 15 with a compatible resin. The additional layers of HMWPE improve performance and are also an option for saving weight.

The outer shell 16 is the core idea of the invention. It wraps the ceramic and backing structure completely and arrests the ceramic compressed inside. This arrested state gives the composite its multi-hit capabilities.

The outer shell is also made of antiballistic material: aramid of various types, Zylon®, or fiberglass S or E fibers, or other antiballistic materials. These fibers can be used in the form of woven cloth, such as plain weave, or unidirectional tape (non-woven), the fabric being used to wrap the ceramic article. Alternatively, the ceramic can be enveloped by the antiballistic fibers by means of filament winding, or braiding, for example. Preferably, the selected materials include fibers of ballistic quality, i.e., high strain, relatively high modulus, high elongation. The fibers are then immersed in a suitable amount of epoxy, polyester, phenolic, polyurethanic resin, or other resin known for structural use. The outer shell thickness can be, for example, 0.2–5 mm, or more.

It will be appreciated that the backing material is formed of antiballistic material with a compatible resin for improving antiballistic properties, such as described in detail in U.S. Pat. No. 5,677,029 to Allied Signal, while the outer shell can be formed of similar antiballistic material, but with a compatible structural resin, as known and used, for example, in airplane construction. The outer shell layers and resin content are selected according to the level of multi-hit required and weight limitations.

It is a particular feature of the present invention that no additives are required in the ceramic plate. In fact, inserts having substantially improved antiballistic capabilities, as compared with conventional inserts, can be formed by the present method from standard ceramics and standard antiballistic materials.

The method of forming the anti-ballistic article of the present invention is as follows. A ceramic monolith of the desired dimensions is prepared and coupled to a selected backing material. This structure is completely enclosed in a selected outer shell material and immersed in the appropriate resin. The wrapped structure, which includes uncured resin in the outer shell, is put in a vacuum sealed bag for compaction (so as to provide uniform pressure all around the surface of the article), as known. The plate is then inserted into an autoclave, hydroclave or isostatic press, and the pressure is raised to the desired level, before the resin in the outer shell cures. The pressure should be as high as possible, since the antiballistic characteristics of the finished insert improve in relation to the amount of pressure applied during curing. Thus, the pressure applied is at least about 10 atm, preferably 15 atm, and most preferably 30 atm and higher. At present, in conventional hydroclaves, the pressure applied is 80 atm, preferably 220 atm, and most preferably 440 atm and higher.

While applying pressure, the temperature is raised to the curing temperature of the resin and a curing cycle is applied. The curing process can take place in an autoclave, hydroclave, an isostatic press, or any other means for applying homogeneous pressure over the entire surface area of the wrapped article. The curing temperature depends on the particular resin and composite antiballistic fabrics, typically between room temperature (about 70°), about 125° for HMWPE and approximately 180° for Kevlar. It is important that the resin in the outer shell be properly and completely cured according to the manufacturer's specifications, including post curing, if necessary, in order to impart the optimum structural properties to the finished article.

After curing, the sample is cooled to room temperature and then the pressure is released, causing an arresting condition in the plate. This arresting condition stops the crack propagation in the ceramic and enhances the multi-hit capabilities.

It is a particular feature of articles according to the present invention that the outer shell does not break when hit by bullets or other materials up to the selected threat level. Rather, the impact pressure which is not absorbed by the outer shell is transferred to the ceramic core, which may crack, but does not break due to the arresting condition induced and restrained therein during the curing process and by the outer shell. As with conventional multi-hit articles, additional hits at small distances from each other can be withstood by the article. In order to reduce the distance between hits which prevents penetration, the pressure before and during the curing process can be raised, and/or different combinations of ceramic plate thicknesses and number of composite backing layers can be utilized.

The article according to the present invention can be formed to any configuration. For example, the basic ceramic can be formed to various dimensions of ballistic inserts for anti-ballistic vests of any level. The insert may be small or completely cover large sections of the body in front and back. Helmets and other protective accessories can further be protected by using this procedure. In addition, armor formed according to the present invention can be utilized to protect materiel, such as vehicles, helicopters, aircraft, and so on, against projectiles (particularly perforating bullets), shrapnel, and the like.

It will be appreciated that the invention is not limited to what has been described hereinabove merely by way of example. Rather, the invention is limited solely by the claims which follow.

What is claimed is:

1. An antiballistic article comprising:

a ceramic monolith;

an antiballistic backing material affixed to said ceramic monolith; and a completely closed outer shell, formed of an antiballistic material including a curable resin, enclosing said backing and ceramic monolith;

said curable resin being cured after and while said enclosed backing and ceramic monolith is maintained under isostatic pressure of at least 10 atmospheres.

2. The antiballistic article according to claim 1, wherein said pressure is at least 15 atmospheres.

3. The antiballistic article according to claim 2, wherein said pressure is maintained by means of a high pressure hydroclave or isostatic press, and is at least 80 atmospheres.

4. The antiballistic article according to claim 1, wherein said ceramic monolith includes alumina, silicon carbide, silicone nitride, boron carbide, titanium diborate, or tungsten carbide.

5. The antiballistic article according to claim 1, wherein said backing material includes an aramid, HMWPE, E Glass, S Glass, Fiberglas (E and S), Zylon or combination hybrids, combined with a compatible resin.

6. The antiballistic article according to claim 1, wherein said outer shell includes:

an antiballistic material; and a compatible resin for structural use.

7. The antiballistic article according to claim 6, wherein said antiballistic material is selected from aramid, Zylon®, E glass, S glass, or fiberglass fibers, or combination hybrids.

8. The antiballistic article according to claim 7, wherein said antiballistic material covers said ceramic monolith in the form of a plain weave cloth, a unidirectional tape, filament winding, or braiding.

9. The antiballistic article according to claim 6, wherein said resin is selected from epoxy, polyester, phenolic, or polyurethanic resin.

10. The antiballistic article according to claim 1, wherein the article is shaped as an insert for personal body armor.

11. The antiballistic article according to claim 1, wherein the article is shaped as an insert for a helmet.

12. The antiballistic article according to claim 1, wherein the article is shaped as an insert for materiel.

13. A method of forming an antiballistic article comprising the steps of:

forming a ceramic monolith;

affixing an antiballistic backing material to said ceramic monolith;

enclosing said backing and ceramic monolith by an outer shell formed of an antiballistic material including a curable resin; and placing said enclosed backing and ceramic monolith under isostatic pressure of at least 10 atmospheres; and curing said curable resin while said enclosed backing and ceramic monolith is maintained under pressure of at least 10 atmospheres.

14. The method according to claim 13, wherein said step of curing is performed in an isostatic press.

15. The method according to claim 13, wherein said step of curing is performed in an autoclave or a hydroclave.

16. The method according to claim 13, wherein said steps of placing and curing are performed at an isostatic pressure of about 10 to about 80 atmospheres.

17. The method according to claim 13, wherein said step of affixing an antiballistic material includes affixing two different antiballistic backing materials to said ceramic monolith.

18. The method according to claim 13, wherein said step of curing includes:

heating said curable resin to a curing temperature of said curable resin while said enclosed backing and ceramic monolith is maintained under pressure;

cooling said curable resin to room temperature while said enclosed backing and ceramic monolith is maintained under pressure; and releasing said pressure on said enclosed backing and ceramic monolith.

19. The antiballistic article according to claim 2, wherein said ceramic monolith includes alumina, silicon carbide, silicone nitride, boron carbide, titanium diborate, or tungsten carbide.

20. The antiballistic article according to claim 3, wherein said ceramic monolith includes alumina, silicon carbide, silicone nitride, boron carbide, titanium diborate, or tungsten carbide.

* * * * *